US009530378B2

(12) United States Patent
Liu

(10) Patent No.: US 9,530,378 B2
(45) Date of Patent: Dec. 27, 2016

(54) DRIVING CIRCUIT OF DISPLAY APPARATUS

(71) Applicant: Raydium Semiconductor Corporation, Hsinchu (TW)

(72) Inventor: Cheng-Chin Liu, Taichung (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 68 days.

(21) Appl. No.: 14/731,698

(22) Filed: Jun. 5, 2015

(65) Prior Publication Data

US 2015/0364077 A1 Dec. 17, 2015

(30) Foreign Application Priority Data

Jun. 13, 2014 (TW) ..... 103120602 A

(51) Int. Cl.
*G09G 5/10* (2006.01)
*G09G 3/36* (2006.01)

(52) U.S. Cl.
CPC ..... *G09G 3/3696* (2013.01); *G09G 3/3688* (2013.01); *G09G 2320/0673* (2013.01); *G09G 2360/16* (2013.01)

(58) Field of Classification Search
CPC ..... G09G 3/2081; G09G 2320/0673; G09G 1310/0272
USPC ..... 345/89, 212, 215, 690, 694
See application file for complete search history.

(56) References Cited

U.S. PATENT DOCUMENTS

2009/0295831 A1* 12/2009 Yanagi ..... G09G 5/003 345/643
2010/0171770 A1* 7/2010 Inoue ..... G09G 3/2014 345/690

* cited by examiner

*Primary Examiner* — Calvin C Ma

(57) ABSTRACT

A driving circuit, for driving a display panel of a display apparatus, includes a control module, a gamma-voltage generation module, and a conversion outputting module. The control module provides a first control voltage and a second control voltage which are adjustable. The first control voltage is higher than the second control voltage. The gamma-voltage generation module generates a gamma voltage according to the first control voltage and the second control voltage. The conversion outputting module converts the gamma voltage into a driving voltage and outputs it to the display panel. When the display panel is over-loaded, the control module adjusts the first control voltage and/or the second control voltage to change the gamma voltage generated by the gamma-voltage generation module, and the driving voltage outputted by the conversion outputting module is changed accordingly to adjust a curve of a panel voltage on the display panel versus time.

10 Claims, 4 Drawing Sheets

DRIVING CIRCUIT OF DISPLAY APPARATUS

BACKGROUND OF THE INVENTION

Field of the Invention

This invention relates to a display apparatus, especially to a driving circuit of a display apparatus.

Description of the Related Art

As to a small-size display panel, with the increasing of the resolution of the display panel, the time that the display panel allows to charge becomes shorter; therefore, the mechanism of charging in a short time becomes more important. At the same time, the loading of the display panel becomes heavier.

However, the driving IC of the display panel can only decrease the loading of the display panel to solve the problem of time constant RC limitation. For example, if a resistance (R) of the display panel=10KΩ and a capacitance (C) of the display panel=100 pF, then a time constant (RC)=1 μs and the display panel at least needs a time of 5 μs to be charged to reach 99% of the ideal panel voltage. Once the time that the display panel allows to charge is only 4 μs, the display panel can be only charged to reach 98.3% of the ideal panel voltage. It fails to be charged to reach 99% of the ideal panel voltage.

Therefore, the invention provides a driving circuit of a display apparatus to solve the above-mentioned problems.

SUMMARY OF THE INVENTION

A preferred embodiment of the invention is a driving circuit of a display apparatus. In this embodiment, the driving circuit is used to drive a display panel of the display apparatus. The driving circuit includes a control module, a gamma-voltage generation module, and a conversion outputting module. The control module provides a first control voltage and a second control voltage. The first control voltage and the second control voltage are both adjustable. The first control voltage is higher than the second control voltage. The gamma-voltage generation module generates a gamma voltage according to the first control voltage and the second control voltage. The conversion outputting module converts the gamma voltage into a driving voltage and outputs the driving voltage to the display panel. When the display panel is over-loaded, the control module adjusts the first control voltage and/or the second control voltage to change the gamma voltage generated by the gamma-voltage generation module, and the driving voltage outputted by the conversion outputting module is changed accordingly to adjust a curve of a panel voltage on the display panel versus time.

In an embodiment, the conversion outputting module includes a plurality of digital-analog conversion units and a plurality of driving amplifiers. The plurality of digital-analog conversion units is coupled to the conversion outputting module and used for converting the digital gamma voltage into the analog driving voltage. The plurality of driving amplifiers is coupled to the plurality of digital-analog conversion units and a plurality of pixels of the display panel respectively and used for outputting the driving voltage to the plurality of pixels of the display panel respectively.

In an embodiment, when the display panel is over-loaded, the control module increases the first control voltage from a first voltage value to a second voltage value. After a first period of time, the control module adjusts the first control voltage from the second voltage value back to the first voltage value, and the second voltage value is higher than the first voltage value.

In an embodiment, in the first period of time, a first curve of the panel voltage varied with time is raised from an original curve of the panel voltage varied with time when the first control voltage is maintained the first voltage value, then the panel voltage needs less time to reach a target voltage becomes shorter.

In an embodiment, the first period of time is adjustable.

In an embodiment, when the display panel is over-loaded, the control module decreases the second control voltage from a third voltage value to a fourth voltage value, after a second period of time, the control module adjusts the second control voltage from the fourth voltage value back to the third voltage value, and the fourth voltage value is lower than the third voltage value.

In an embodiment, in the second period of time, a second curve of the panel voltage varied with time is lowered from an original curve of the panel voltage varied with time when the second control voltage is maintained the third voltage value, then the panel voltage needs less time to reach a target voltage becomes shorter.

In an embodiment, the second period of time is adjustable.

In an embodiment, the control module knows that the display panel is over-loaded according to a feedback signal from the display panel and then adjusts the first control voltage and/or the second control voltage accordingly.

In an embodiment, the control module adjusts the first control voltage and/or the second control voltage at least one time.

Compared to the prior art, the driving circuit of the display apparatus in the invention changes the first control voltage VGP or the second control voltage VGS to make instant variation of the gamma-voltage generated by the gamma-voltage generation module 22, so that the curve of the panel voltage Vpan of the display panel PAN varied with time can be adjusted to form an overdrive to effectively overcome the limitations of the time constant RC and the loading of the display panel PAN. Therefore, the panel voltage Vpan of the display panel PAN can be rapidly charged to reach 99% of the target panel voltage Vtar to meet the very short time allowed by the small-size display panel to be charged.

The advantage and spirit of the invention may be understood by the following detailed descriptions together with the appended drawings.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A preferred embodiment of the invention is a driving circuit of a display apparatus. In this embodiment, the display apparatus is a liquid crystal display including a LCD panel and the driving circuit. The driving circuit can be a source driver of the display apparatus, but not limited to this.

At first, the aim of the invention is not a mechanism of charging in a short time, but a time-controllable mechanism. Since the output voltage of the driving circuit of small-sized display panel is adjustable, this adjustable output voltage can be used to control the charging time.

Figure 1:
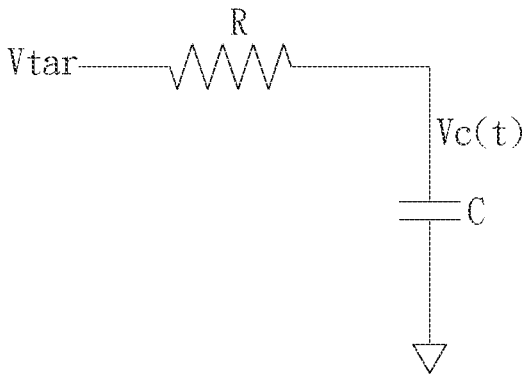
FIG. 1 illustrates a schematic diagram of the capacitor of the display panel being charged by the output voltage of the driving circuit through the resistor.

As shown in FIG. 1, it is assumed that a target voltage outputted by the driving circuit is Vtar, an original voltage of a capacitor C of the display panel is Vini. After the capacitor C of the display panel is charged by the target voltage Vtar through a resistor R for a period of time t, a capacitor voltage Vc(t) will be:

$$Vc(t)=Vini+Vtar(1-e^{t/RC}) \quad \text{(equation 1)}$$

Because the target voltage Vtar outputted by the driving circuit is controllable, the equation 1 can be:

$$Vc(t)=Vini+Vtar1(1-e^{t1/RC})+Vtar2(1-e^{t2/RC}) \quad \text{(equation 2)}$$

Wherein, the controllable time t equals to a total of a first time t1 and a second time t2; Vtar1 is a target voltage in the first time t1 and Vtar2 is a target voltage in the second time t2.

Then, during the process of charging the capacitor C of the display panel, a dynamic gamma control (DGC) mechanism is used in the invention to achieve overdrive effect.

Figure 2:
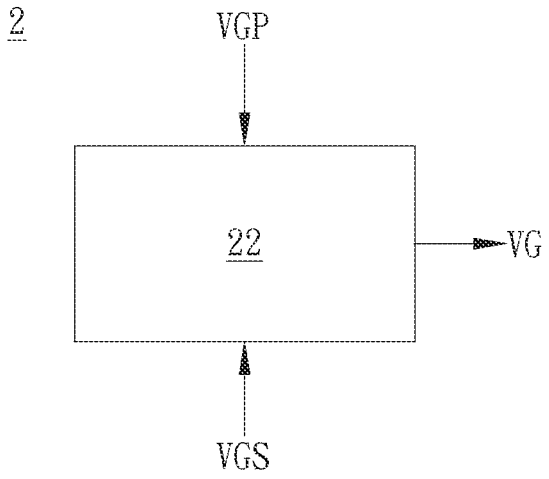
FIG. 2 illustrates a schematic diagram of the gamma-voltage generator generating a gamma-voltage according to the first control voltage and the second control voltage.

As shown in FIG. 2, a gamma voltage generator 22 of the driving circuit 2 is used to generate a gamma voltage VG as a reference voltage of IC source electrode data. The gamma voltage VG generated by the gamma voltage generator 22 is changed by adjusting a first control voltage VGP and a second control voltage VGS. Therefore, different analog voltages can be found in the same digital data to achieve the effect of overdrive. In fact, the first control voltage VGP is higher than the second control voltage VGS, but not limited to this.

In prior arts, since a regulating capacitor is added to the conventional first control voltage VGP and second control voltage VGS, the first control voltage VGP and second control voltage VGS fail to change immediately, and the gamma voltage generated by the gamma voltage generator also fails to change immediately. However, with the progress of technology, the regulating capacitor is unnecessary for the first control voltage VGP and the second control voltage VGS in this invention; therefore, the gamma voltage VG generated by the gamma voltage generator 22 can be changed immediately by changing the first control voltage VGP and the second control voltage VGS.

Figure 3A:
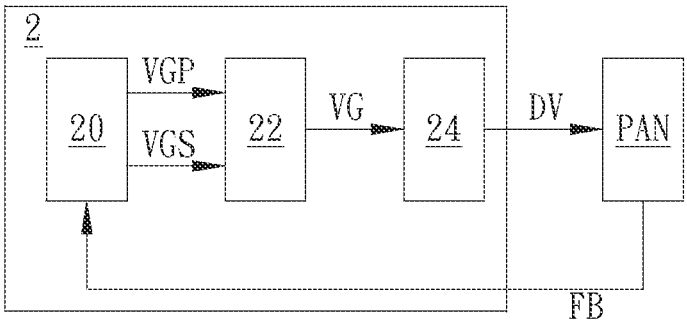
FIG. 3A illustrates a functional block diagram of the driving circuit and the display panel.

Please refer to FIG. 3A. FIG. 3A illustrates a functional block diagram of the driving circuit and the display panel. As shown in FIG. 3A, the driving circuit 2 includes a control module 20, a gamma voltage generation module 22, and a conversion outputting module 24. The control module 20 is coupled to the gamma voltage generation module 22; the gamma voltage generation module 22 is coupled to the conversion outputting module 24; the conversion outputting module 24 is coupled to a display panel PAN; the display panel PAN is coupled to the control module 20.

The control module 20 is used to provide the first control voltage VGP and the second control voltage VGS to the gamma voltage generation module 22, wherein the first control voltage VGP and the second control voltage VGS are adjustable, and the first control voltage VGP is higher than the second control voltage VGS.

The gamma voltage generation module 22 is used to generate a gamma voltage VG according to the first control voltage VGP and the second control voltage VGS and output the gamma voltage VG to the conversion outputting module 24. The conversion outputting module 24 is used to convert the digital gamma voltage VG into an analog driving voltage DV and output the driving voltage DV into the display panel PAN.

When the loading of the display panel PAN is overloaded, the display panel PAN will output a feedback signal FB to the control module 20. When the control module 20 knows that the loading of the display panel PAN is overloaded according to the feedback signal FB, the control module 20 will adjust the first control voltage VGP and/or the second control voltage VGS to change the gamma voltage VG generated by the gamma voltage generation module 22, and the driving voltage DV outputted by the conversion outputting module 24 will be also changed to adjust the curve of the panel voltage of the display panel PAN varied with time.

Next, an example of the source driving circuit 2 driving the display panel PAN will be introduced as follows.

Figure 3B:
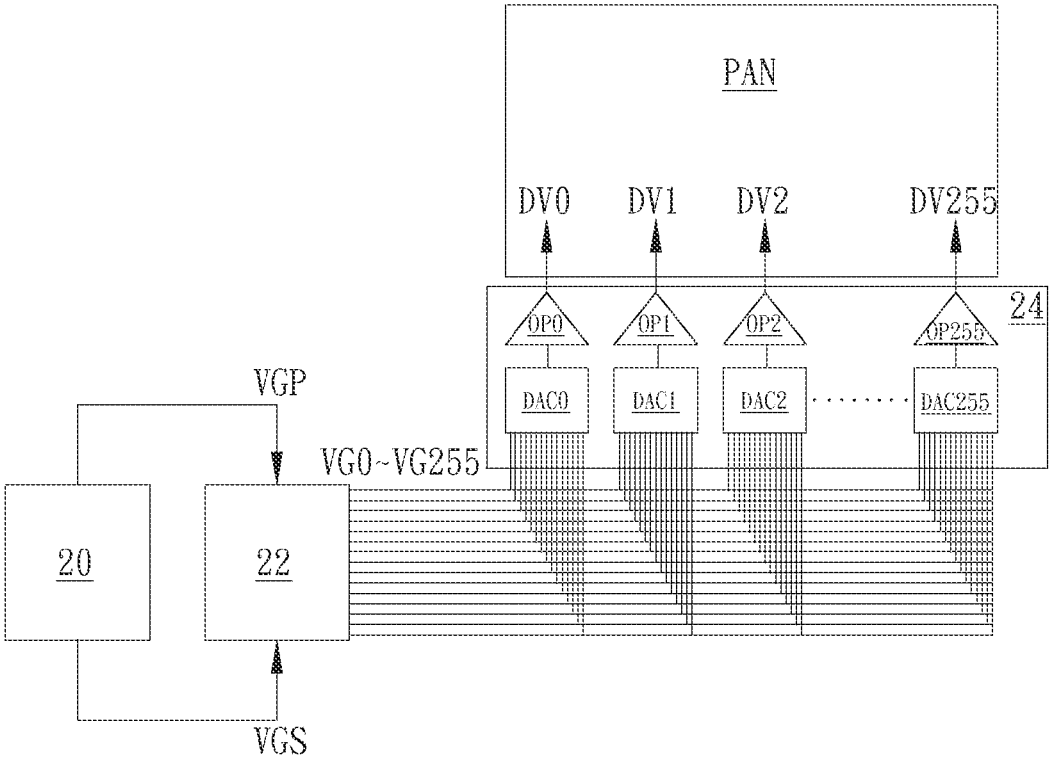
FIG. 3B illustrates an embodiment of the driving circuit outputting a driving voltage to the display panel.

Please refer to FIG. 3B. As shown in FIG. 3B, the control module 2 provides the adjustable first control voltage VGP and second control voltage VGS to the gamma voltage generation module 22, wherein the first control voltage VGP is higher than the second control voltage VGS. Then, the gamma voltage generation module 22 will generate a plurality of gamma voltages VG0~VG255 according to the first control voltage VGP and the second control voltage VGS, and output the plurality of gamma voltages VG0~VG255 to a plurality of digital-to-analog converters DAC0~DAC255 of the conversion outputting module 24 respectively.

The plurality of digital-to-analog converters DAC0~DAC255 will convert the plurality of digital gamma voltages VG0~VG255 into a plurality of analog driving voltages DV1~DV255 respectively, and output the plurality of analog driving voltages DV1~DV255 to the display panel PAN through a plurality of source driving amplifiers OP0~OP255 respectively.

When the loading of the display panel PAN is overloaded, the invention provides two ways to increase output speed as follows.

(1) When the loading of the display panel PAN is overloaded, the display panel PAN will output the feedback signal FB to the control module 20 of the driving circuit 2. When the control module 20 knows that the loading of the display panel PAN is overloaded according to the feedback signal FB, the control module 20 will increase the first control voltage VGP from a first voltage value to a second voltage value. After a period of time, the control module 20 will decrease the first control voltage VGP from the second voltage value to the first voltage value. The second voltage value is higher than the first voltage value.

Figure 4B:
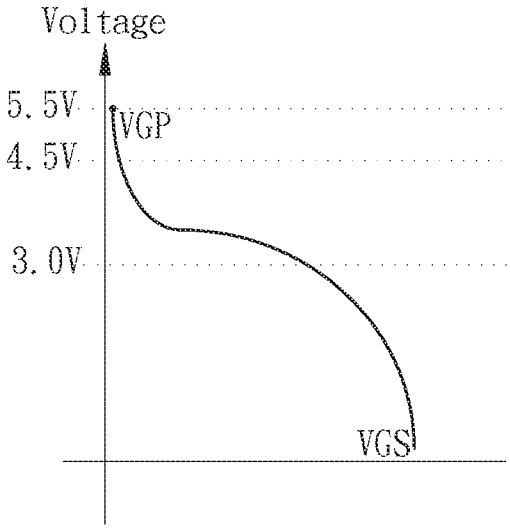
FIG. 4B illustrates that when the display panel is overloaded, the first control voltage will be increased to 5.5 volts.
Figure 4A:
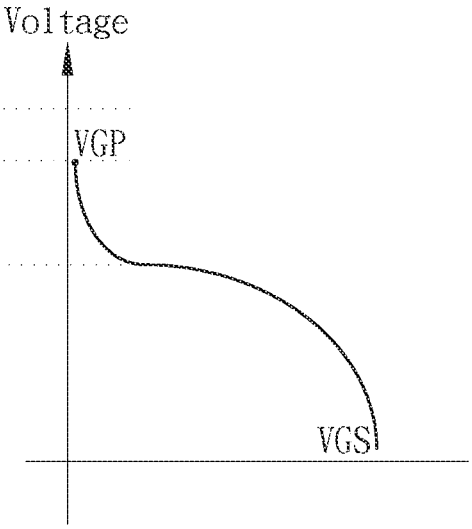
FIG. 4A illustrates that the original first control voltage is 4.5 volts.

For example, if the original voltage value of the first control voltage VGP is 4.5 volts (as shown in FIG. 4A), when the display panel PAN is overloaded, the control module 20 will increase the first control voltage VGP from 4.5 volts to 5.5 volts (as shown in FIG. 4B). After a period of time (e.g., 3RC=3 μsec), the control module 20 will decrease the first control voltage VGP from 5.5 volts back to the original 4.5 volts (as shown in FIG. 4A).

Figure 4C:
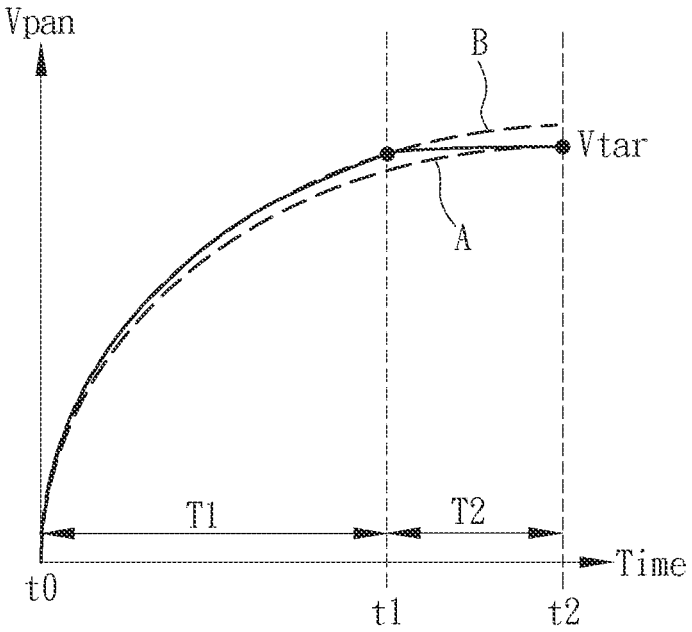
FIG. 4C illustrates a curve diagram of the panel voltage of the display panel varied with time.

Please refer to FIG. 4C. FIG. 4C illustrates a curve diagram of the panel voltage Vpan of the display panel PAN varied with time t. As shown in FIG. 4C, the dotted line A is a curve of the panel voltage Vpan varied with time t when the first control voltage VGP continuously maintains 4.5 volts; the dotted line B is a curve of the panel voltage Vpan varied with time t when the first control voltage VGP continuously maintains 5.5 volts. Obviously, the dotted line B is located above the dotted line A. That is to say, higher first control voltage VGP can increase the charging speed of the panel voltage Vpan and reduce the charging time needed to charge the panel voltage Vpan to the target panel voltage Vtar.

When the control module 20 increases the first control voltage VGP from 4.5 volts to 5.5 volts at a time t0, the curve of the panel voltage Vpan is varied with time t along the dotted line B; after a first period of time T1, when the control module 20 decreases the first control voltage VGP from 5.5 volts to 4.5 volts at a time t1, the curve of the panel voltage Vpan varied with time t along the dotted line B will start to approach the dotted line B to reach the target panel voltage Vtar.

The mechanism of using the control module 20 to increase the first control voltage VGP to form overdrive can effectively overcome the limitations of time constant RC and overload of the display panel PAN. When the resistance (R) of the display panel PAN is 10KΩ and the capacitance (C) of the display panel PAN is 100 pF, the panel voltage Vpan of the display panel PAN only needs a time of 5 μsec(=5RC) to be charged to 99% of the target panel voltage Vtar. Therefore, the short charging time limitation of small-size display panel can be met.

(2) When the loading of the display panel PAN is overloaded, the display panel PAN will output the feedback signal FB to the control module 20 of the driving circuit 2. When the control module 20 knows that the loading of the display panel PAN is overloaded according to the feedback signal FB, the control module 20 will decrease the second control voltage VGS from a third voltage value to a fourth voltage value. After a period of time, the control module 20 will increase the second control voltage VGS from the fourth voltage value to the third voltage value. The third voltage value is higher than the fourth voltage value.

Figure 5A:
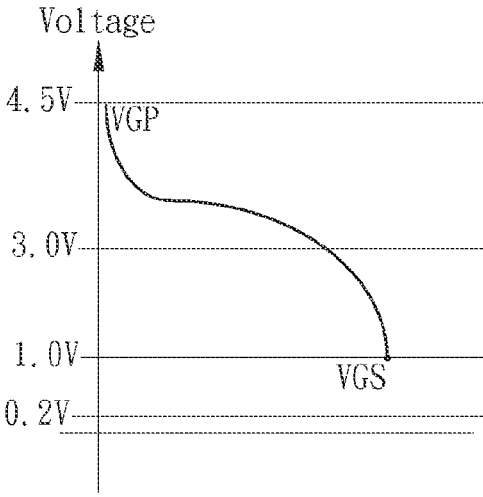
FIG. 5A illustrates that the original second control voltage is 1 volt.
Figure 5B:
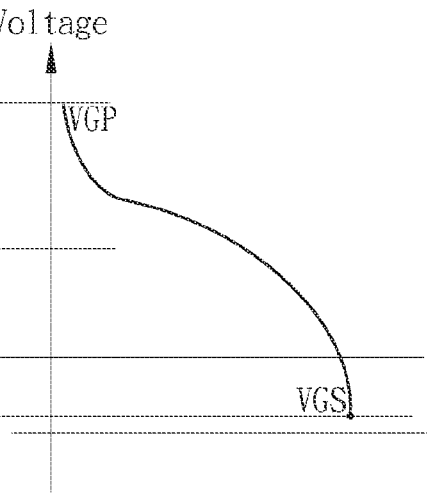
FIG. 5B illustrates that when the display panel is overloaded, the second control voltage will be decreased to 0.2 volts.

For example, if the original voltage value of the second control voltage VGS is 1 volt (as shown in FIG. 5A), when the display panel PAN is overloaded, the control module 20 will decrease the second control voltage VGS from 1 volt to 0.2 volts (as shown in FIG. 5B). After a period of time (e.g., 3RC=3 μsec), the control module 20 will increase the second control voltage VGS from 0.2 volts back to the original 1 volt (as shown in FIG. 5A).

Figure 5C:
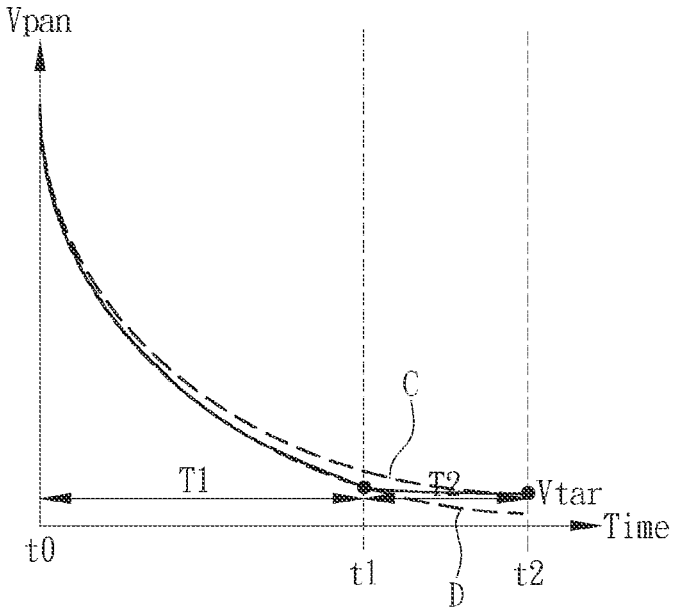
FIG. 5C illustrates a curve diagram of the panel voltage of the display panel varied with time.

Please refer to FIG. 5C. FIG. 5C illustrates a curve diagram of the panel voltage Vpan of the display panel PAN varied with time t. As shown in FIG. 5C, the dotted line C is a curve of the panel voltage Vpan varied with time t when the second control voltage VGP continuously maintains 1 volt; the dotted line D is a curve of the panel voltage Vpan varied with time t when the second control voltage VGS continuously maintains 0.2 volts. Obviously, the dotted line D is located below the dotted line C. That is to say, lower second control voltage VGS can increase the charging speed of the panel voltage Vpan and reduce the charging time needed to charge the panel voltage Vpan to the target panel voltage Vtar.

When the control module 20 decreases the second control voltage VGS from 1 volt to 0.2 volts at a time t0, the curve of the panel voltage Vpan is varied with time t along the dotted line D; after a first period of time T1, when the control module 20 increases the second control voltage VGS from 0.2 volts to 1 volt at a time t1, the curve of the panel voltage Vpan varied with time t along the dotted line D will start to approach the dotted line C to reach the target panel voltage Vtar.

The mechanism of using the control module 20 to decrease the second control voltage VGS to form overdrive can effectively overcome the limitations of time constant RC and overload of the display panel PAN. When the resistance (R) of the display panel PAN is 10KΩ and the capacitance (C) of the display panel PAN is 100 pF, the panel voltage Vpan of the display panel PAN only needs a time of 5 μsec(=5RC) to be charged to 99% of the target panel voltage Vtar. Therefore, the short charging time limitation of small-size display panel can be met.

It should be noticed that the mechanism of using the control module 20 to decrease the second control voltage VGS and the mechanism of using the control module 20 to increase the first control voltage VGP can be also used together to form overdrive. In addition, in order to avoid too much overdrive, the control module 20 can also adjust the first control voltage VGP and the second control voltage VGS several times.

For example, it is assumed that the original first control voltage VGP is 4.5 volts, if the control module 20 increases the first control voltage VGP from 4.5 volts to 6.5 volts at a time t0; after a period of time T1, since the panel voltage Vpan is too much higher than the target panel voltage Vtar, the control module 20 decreases the first control voltage VGP from 6.5 volts to 4.5 volts at a time t1. After another period of time T2, since the panel voltage Vpan is too much lower than the target panel voltage Vtar, the control module 20 increases the first control voltage VGP from 4.5 volts to 6.5 volts again at a time t2 to reach the target panel voltage Vtar.

Compared to the prior art, the driving circuit of the display apparatus in the invention changes the first control voltage VGP or the second control voltage VGS to make instant variation of the gamma-voltage generated by the gamma-voltage generation module 22, so that the curve of the panel voltage Vpan of the display panel PAN varied with time can be adjusted to form an overdrive to effectively overcome the limitations of the time constant RC and the loading of the display panel PAN. Therefore, the panel voltage Vpan of the display panel PAN can be rapidly charged to reach 99% of the target panel voltage Vtar to meet the very short time allowed by the small-size display panel to be charged.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

The invention claimed is:

1. A driving circuit of a display apparatus, for driving s plurality of pixels of a display panel of a display apparatus, the driving circuit comprising:

a control module, for providing a first control voltage and a second control voltage, wherein the first control voltage and the second control voltage are adjustable, and the first control voltage is higher than the second control voltage;

a gamma-voltage generation module, coupled to the control module, for generating a gamma voltage according to the first control voltage and the second control voltage; and a conversion outputting module, coupled between the gamma-voltage generation module and the display panel, for converting the gamma voltage into a driving voltage and then outputting the driving voltage to the display panel;

wherein when the display panel is over-loaded, the control module adjusts the first control voltage and/or the second control voltage to change the gamma voltage generated by the gamma-voltage generation module, and the driving voltage outputted by the conversion outputting module is changed accordingly to adjust a curve of a panel voltage on the display panel versus time.

2. The driving circuit of claim 1, wherein the conversion outputting module comprises:

a plurality of digital-analog conversion units, coupled to the conversion outputting module, for converting the digital gamma voltage into the analog driving voltage; and a plurality of driving amplifiers, coupled to the plurality of digital-analog conversion units and a plurality of pixels of the display panel respectively, for outputting the driving voltage to the plurality of pixels of the display panel respectively.

3. The driving circuit of claim 1, wherein when the display panel is over-loaded, the control module increases the first control voltage from a first voltage value to a second voltage value, after a first period of time, the control module adjusts the first control voltage from the second voltage value back to the first voltage value, and the second voltage value is higher than the first voltage value.

4. The driving circuit of claim 3, wherein the first period of time, a first curve of the panel voltage varied with time is raised from an original curve of the panel voltage varied with time when the first control voltage is maintained the first voltage value, then the panel voltage needs less time to reach a target voltage becomes shorter.

5. The driving circuit of claim 3, wherein the first period of time is adjustable.

6. The driving circuit of claim 1, wherein when the display panel is over-loaded, the control module decreases the second control voltage from a third voltage value to a fourth voltage value, after a second period of time, the control module adjusts the second control voltage from the fourth voltage value back to the third voltage value, and the fourth voltage value is lower than the third voltage value.

7. The driving circuit of claim 6, wherein in the second period of time, a second curve of the panel voltage varied with time is lowered from an original curve of the panel voltage varied with time when the second control voltage is maintained the third voltage value, then the panel voltage needs less time to reach a target voltage becomes shorter.

8. The driving circuit of claim 6, wherein the second period of time is adjustable.

9. The driving circuit of claim 1, wherein the control module knows that the display panel is over-loaded according to a feedback signal from the display panel and then adjusts the first control voltage and/or the second control voltage accordingly.

10. The driving circuit of claim 1, wherein the control module adjusts the first control voltage and/or the second control voltage at least one time.

* * * * *